US010238151B2

(12) United States Patent
Jeong

(10) Patent No.: US 10,238,151 B2
(45) Date of Patent: Mar. 26, 2019

(54) TOE SOCK AND MANUFACTURING METHOD THEREOF

(71) Applicant: Hong-Gi Jeong, Gyeonggi-do (KR)

(72) Inventor: Hong-Gi Jeong, Gyeonggi-do (KR)

( * ) Notice: Subject to any disclaimer, the term of this patent is extended or adjusted under 35 U.S.C. 154(b) by 0 days.

(21) Appl. No.: 15/525,279

(22) PCT Filed: Mar. 3, 2016

(86) PCT No.: PCT/KR2016/002102
§ 371 (c)(1),
(2) Date: May 8, 2017

(87) PCT Pub. No.: WO2016/144036
PCT Pub. Date: Sep. 15, 2016

(65) Prior Publication Data

US 2017/0325513 A1 Nov. 16, 2017

(30) Foreign Application Priority Data

Mar. 6, 2015 (KR) ..... 10-2015-0031714

(51) Int. Cl.
*A41B 11/00* (2006.01)
*D03D 1/00* (2006.01)
(Continued)

(52) U.S. Cl.
CPC ..... *A41B 11/004* (2013.01); *A41B 11/003* (2013.01); *D03D 1/00* (2013.01); *D03D 13/004* (2013.01); *D03D 15/0033* (2013.01); *D03D 15/08* (2013.01); *A41B 2500/20* (2013.01); *D10B 2501/043* (2013.01)

(58) Field of Classification Search
CPC ..... A41B 11/00; A41B 11/004; A61F 13/06
See application file for complete search history.

(56) References Cited

U.S. PATENT DOCUMENTS 3,128,763 A * 4/1964 Langenfeld ..... A41B 11/004 128/894
5,774,898 A * 7/1998 Malpee ..... A41B 11/004 2/22

(Continued)

FOREIGN PATENT DOCUMENTS

KR 20-1999-0034110 U 8/1999
KR 20-0215481 Y1 3/2001

(Continued)

*Primary Examiner* — Tajash D Patel
(74) *Attorney, Agent, or Firm* — IP Legal Services, LLC

(57) ABSTRACT

The present invention relates to: a toe sock having toe holes, which are formed by vertically backstitching between the toes of a sock and into which the toes are separately inserted; and a manufacturing method therefor and, more specifically, provided is a part, which has toe holes formed by vertically backstitching between the toes of a sock, formed into a flexible elastic part (20), wherein the elastic part (20) is manufactured by being woven with a flexible yarn and continuously forming wrinkles (22) flexible in the widthwise direction, thereby enabling the toes to be conveniently inserted and worn by the flexible movement of the elastic part (20) and providing an excellent appearance quality because of the low contraction deformation of the appearance of the sock.

6 Claims, 9 Drawing Sheets

(51) Int. Cl.

| | |
|---|---|
| ***D03D 13/00*** | (2006.01) |
| ***D03D 15/00*** | (2006.01) |
| ***D03D 15/08*** | (2006.01) |

(56) References Cited

U.S. PATENT DOCUMENTS

| | | | | |
|---|---|---|---|---|
| 2012/0017354 | A1* | 1/2012 | Vadnais | A41B 11/004 2/239 |
| 2017/0007465 | A1* | 1/2017 | Edwards | A61F 13/068 |
| 2017/0231294 | A1* | 8/2017 | Parnell | A41D 13/0051 2/239 |

FOREIGN PATENT DOCUMENTS

| | | | |
|---|---|---|---|
| KR | 20-2008-0006179 | U | 12/2008 |
| KR | 20-2009-0010411 | U | 10/2009 |
| KR | 10-2011-0030137 | A | 3/2011 |
| KR | 10-1101659 | B1 | 12/2011 |
| KR | 20-2012-0006116 | U | 8/2012 |

* cited by examiner

TOE SOCK AND MANUFACTURING METHOD THEREOF

CROSS REFERENCE TO RELATED APPLICATIONS

This application is a National Stage Patent Application of PCT International Patent Application No. PCT/KR2016/002102 (filed on Mar. 3, 2016) under 35 U.S.C. § 371, which claims priority to Korean Patent Application No. 10-2015-0031714 (filed on Mar. 6, 2015), the teachings of which are incorporated herein in their entireties by reference.

TECHNICAL FIELD

The present invention relates to a toe sock having toe holes, which are formed by vertical backstitch between the toe sections of a sock and into which toes are separately inserted, and a manufacturing method thereof and, more specifically, to a toe sock and a manufacturing method thereof, in which a portion for forming toe holes by backstitch is formed as a wrinkled elastic part by weaving with stretch yarn (rubber thread) such that toes can be conveniently inserted into the toe sock through the stretching of the elastic part and the toe sock has excellent appearance quality with less contraction deformation.

BACKGROUND ART

In general, socks are used for the purpose of protection, warming and the like of feet.

The socks are made by weaving at least one or more kinds of yarn by a loom according to a program so that the socks can have various shapes, patterns and colors, wherein one of them is the toe sock to be worn by inserting toes separately so as to prevent athlete's foot.

Since such a conventional toe sock is manufactured by weaving toe insertion parts separately such as a finger glove, compared with general socks, the manufacturing process of the toe sock is complicated and the appearance of the toe sock is aversion. In particular, there is a problem that the process of wearing the toe sock on each toe individually and separately is very inconvenient.

In order to solve the problems as above, a method for manufacturing a toe sock has been disclosed in Korean Utility Model Publication No. 20-2012-06116, in which a sock is woven in the same manner as a general sock and then toe holes are formed by vertical backstitch between the toe sections of the sock so that toes are separately inserted into toe holes of the sock. Therefore, this toe sock has several advantages over the conventional toe sock, wherein the manufacturing process is simplified and the aversion of the appearance of the toe sock is relieved.

However, such a toe sock still has a problem that since this toe sock is woven in the same manner as a general sock and then the toe holes are formed inside by vertical backstitch between the toe sections of the sock, the toe sock is stiff when toss are inserted into the toe holes, resulting in very uncomfortable wearing.

This is because the width is narrowed due to the contraction deformation of the backstitch region in the process of vertically backstitching between the toe sections of the sock after weaving the sock.

That is, although the toe sock described above has many advantages in that the manufacturing process is simple and the discomfort of the appearance is reduced compared with conventional toe socks, the toe sock is more inconvenient to wear by inserting toes, failing to achieve commercialization or productization.

Meanwhile, according to the toe sock, a sock is woven and then vertical backstitch is carried out between the toe sections of the sock. However, since the position of the backstitch cannot be accurately recognized by a worker during the vertical backstitch, an additional foot-shaped jig is inserted into the sock and then the backstitch is carried out. Therefore, workability is decreased and the backstitch cannot be carried out at uniform positions, deteriorating the commercial value thereof.

DISCLOSURE

Technical Problem

Accordingly, the present invention has been made in an effort to solve the above-mentioned problems and disadvantages occurring in the prior arts, and it is an object of the present invention to provide a toe sock, in which toe holes are formed by vertical backstitch between the toe sections of the sock such that toes can be separately inserted into the toe holes, wherein a portion for forming the toe holes by backstitch is formed as a wrinkled elastic part by weaving with stretch yarn (rubber thread) such that toes can be conveniently inserted into the toe sock through the stretching of the elastic part and the toe sock has excellent appearance quality with less contraction deformation.

It is another object of the present invention to provide a toe sock, in which an elastic part is formed to have a width larger than the widths of positions in front of or behind the elastic part so as to prevent the narrowing of width of the elastic part more than any other parts even in spite of the contraction deformation of a backstitch portion, thereby achieving more excellent appearance quality.

It is still another object of the present invention to provide a toe sock, in which the wrinkles of a big toe insertion part in an elastic part are formed to be more compact than the wrinkles of any other parts or a shape maintenance member formed in an oval shape is coupled to the outside of the elastic part so as to maintain the open shape of toe holes, thereby providing more convenient insertion of toes.

It is yet another object, of the present invention to provide a toe sock, in which a vent hole is formed between the toe sections of the sock, thereby more effectively preventing athlete's foot owing to air permeability.

It is a further object, of the present invention to provide a toe sock, in which a portion for forming toe holes by vertical backstitch between the toe sections of the sock in the weaving process of the sock is formed by weaving with stretch yarn (rubber thread) in such a manner that backstitch positions are woven with yarn in different color so as to form backstitch indication lines such that the backstitch can be carried out simply along the backstitch indication lines without using any additional jig after the weaving of the sock, thereby realizing uniform backstitch and providing excellent marketability.

Technical Solution

In order to solve the above-mentioned problems, according to one aspect of the present invention, there is provided a toe sock having toe holes, which are formed by sewing lines of vertical backstitch between the toe sections of a sock and into which toes are separately inserted, characterized in that a portion for forming the toe holes formed by the sewing lines is formed as an elastic stretch part, wherein the elastic stretch part is formed by weaving with stretch yarn (rubber thread) and has continuously formed wrinkle, which are stretchable in the widthwise direction.

The elastic part of the sock, according to the present invention, has a big toe insertion part, of which wrinkles are formed to be fine so as to be more stretchable than the wrinkles of any other toe insertion parts.

The elastic part of the sock, according to the present invention, is formed to have a width larger than at least the widths of positions in front of or behind the elastic part and then back-stitched, in consideration of the decrease of the width, caused by the sewing line of the vertical backstitch.

The sewing line of the sock, according to the present invention, is formed in an oval shape, and a vent hole is formed through the center of the sewing line.

As for the elastic part of the sock, according to the present invention, a shape maintenance member formed in an oval shape is coupled to the outside of the elastic part of the sock so as to support the toe holes such that the toe holes can be maintained in an open shape.

According to another aspect of the present invention, there is provided a method for manufacturing a toe sock, in which, after weaving a sock with at least one or more kinds of yarn by a loom according to a weaving program, toe holes are formed by vertical backstitch between the toe sections of the sock such that toes are separately inserted thereinto, characterized in that the portion for forming the toe holes by backstitch in the weaving process of the sock is formed by weaving with stretch yarn (rubber thread) in such a manner that backstitch positions are woven with yarn in different color so as to form backstitch indication lines and then the toe holes, into which toes are separately inserted, are formed by vertical backstitch along the backstitch indication lines of the sock.

Advantageous Effects

As described hereinabove, according to the present invention, the toe sock has toe holes formed by vertical backstitch between the toe sections of the sock such that toes can be separately inserted into the toe holes, wherein a portion for forming the toe holes by backstitch is formed as a wrinkled elastic part by weaving with stretch yarn (rubber thread) such that toes can be conveniently inserted into the toe sock through the stretching of the elastic part and the toe sock has excellent appearance quality with less contraction deformation.

In addition, the elastic part of the toe sock is formed to have a width larger than the widths of positions in front of or behind the elastic part so as to prevent the narrowing of the width of the elastic part more than any other parts even in spite of the contraction deformation of the backstitch portion, thereby achieving excellent appearance quality.

Besides, the wrinkles of the big toe insertion part in the elastic part of the toe sock are formed to be more compact than the wrinkles of any other parts or a shape maintenance member formed in an oval shape is coupled to the outside of the elastic part so as to maintain the open shape of toe holes, thereby providing more convenient insertion of toes.

Furthermore, the vent hole is formed between the toe sections of the sock, thereby more effectively preventing athlete's foot owing to air permeability.

Besides, the portion for forming the toe holes by vertical backstitch between the toe sections of the sock in the weaving process of the sock is formed by weaving with stretch yarn (rubber thread) in such a manner that backstitch positions are woven with yarn in different color so as to form the backstitch indication lines such that the backstitch can be carried out simply along the backstitch indication lines without using any additional jig after the weaving of the sock, thereby realizing uniform backstitch and providing excellent marketability.

MODE FOR INVENTION

Figure 1:
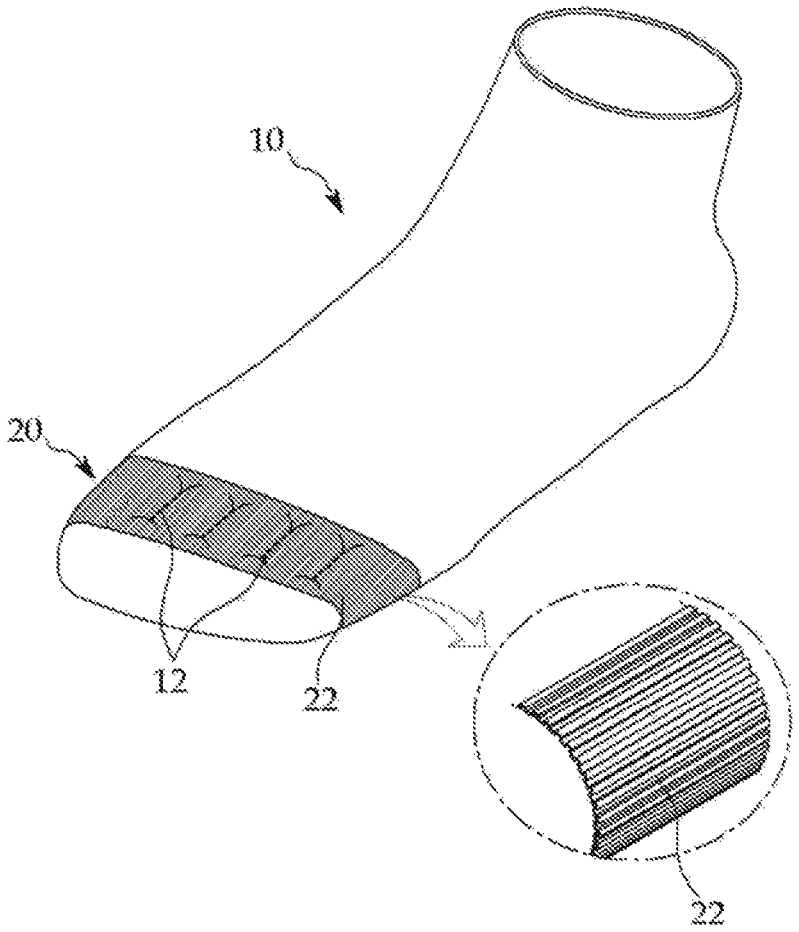
FIG. 1 is a perspective view for showing an embodiment of the present invention.
Figure 2:
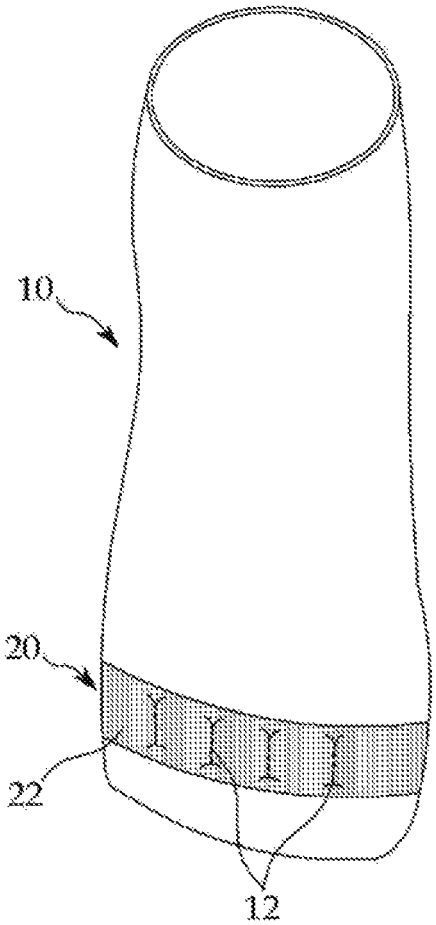
FIG. 2 is a plan view of the sock shown in FIG. 1.
Figure 3:
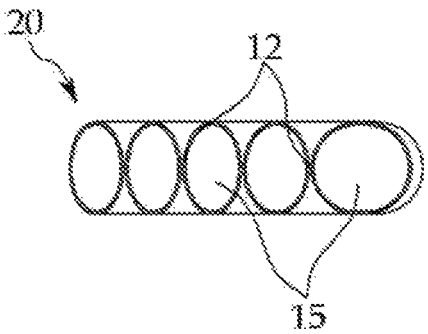
FIG. 3 is a front sectional view for showing an elastic part of FIG. 2.

First, preferred embodiments of the present invention will be described in detail with reference to the accompanying drawings.

As shown in FIG. 1 to FIG. 4, a toe sock 10 according to the present invention includes toe holes 15, which is formed by sewing lines 12 of vertical backstitch between the toe sections of the sock 10 and into which toes are separately inserted.

Particularly, a portion for forming the toe holes 15 formed by the sewing lines 12 is formed as an elastic stretch part s 20, wherein the elastic stretch part 20 is formed by weaving with stretch yarn (rubber thread) and has continuously formed wrinkles 22, which are stretchable in the widthwise direction.

That is, the sock 10 is woven with one or more kinds of yarn by a loom according to a weaving program, wherein the elastic part 20 rather than any other parts is woven to be provided with the wrinkles 22 with the stretch yarn (rubber thread).

Figure 4:
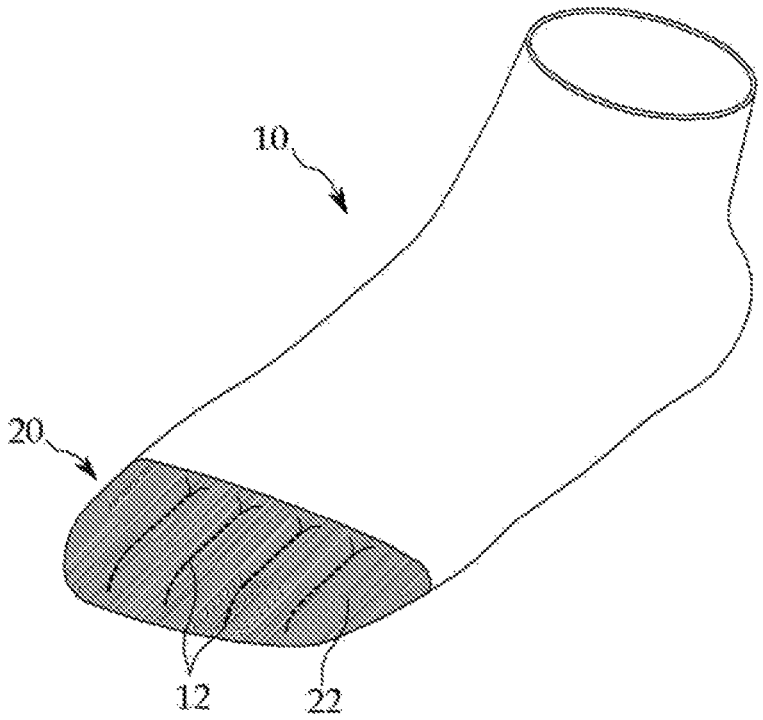
FIG. 4 is a perspective view for showing another embodiment of the present invention.

The elastic part 20 can be partially or fully formed at the toe sections of the sock. When partially forming the elastic part 20, as shown in FIG. 1, a portion having the sewing line 12 of vertical backstitch is woven into the shape of an oval strap. When fully forming the elastic part 20, as shown in FIG. 4, the whole toe sections of the sock 10 are woven into the shape of a cap.

In addition, it is preferable to use the sock 10 in such a manner that a big toe insertion hole is formed to be larger than the remaining holes when the left and right socks are used separately, while a big toe insertion hole and a little toe insertion hole are formed to be larger than the remaining holes when the right and left socks are used without distinction. Herein, even when the little toe insertion hole is formed to be large, the sock can also be worn so as to tightly surround the little toe by the expansion and contraction of the elastic part 20.

Figure 5:
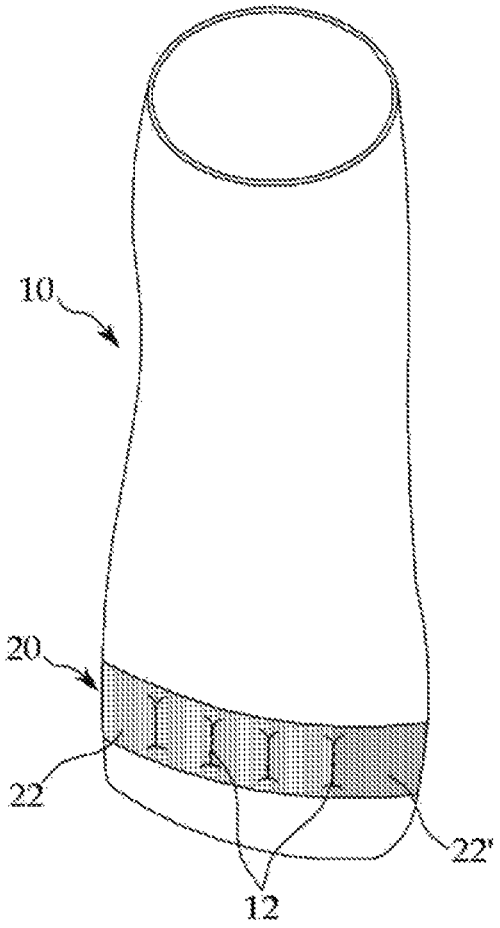
FIG. 5 is a plan view for showing still another embodiment of the present invention.

Besides, according to the present invention, it is preferable that wrinkles 22' of a big toe insertion part is formed to be more compact than the wrinkles 22 of the remaining toe insertion parts in the elastic part 20 of the sock 10, as shown in FIG. 5.

That is, since the big toe is thicker than the remaining toes, the big toe insertion part, is formed to be more expanded and contracted than the remaining toe insertion parts, thereby facilitating convenient wearing of the sock.

Figure 6:
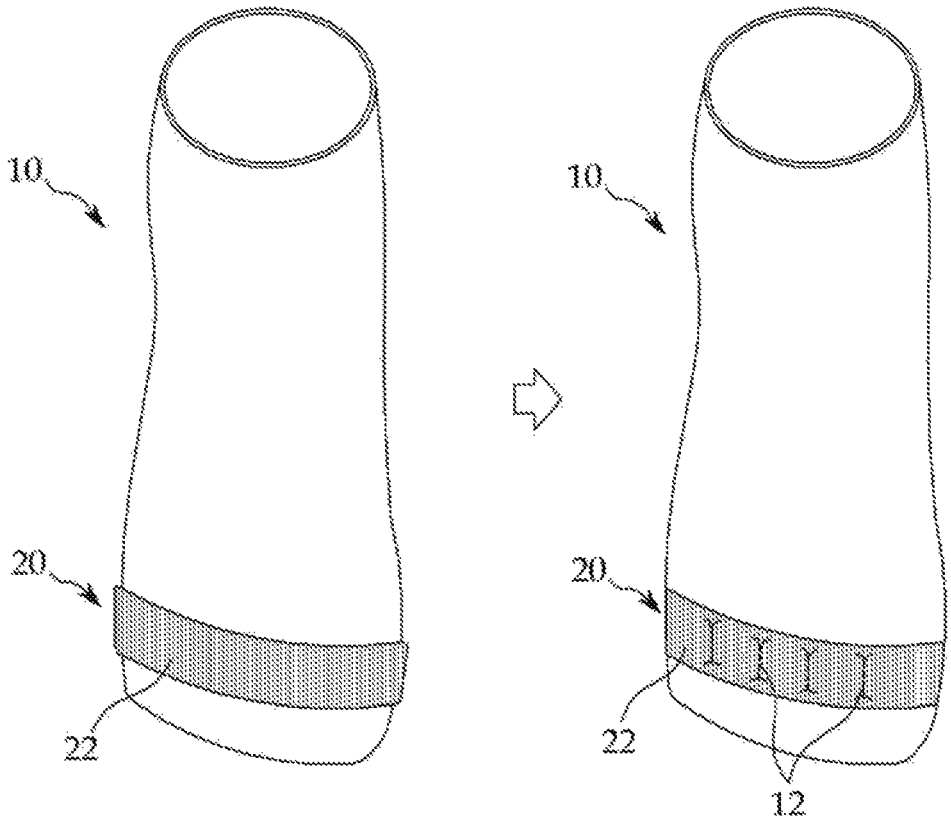
FIG. 6 is a plan view for showing a further embodiment of the present invention.

In addition, a toe sock can be implemented according to another embodiment of the present invention, as shown in FIG. 6, in which the backstitch is carried out such that the elastic part 20 of the sock 10 is formed to have a larger width in consideration of the narrowing degree of the width due to the backstitch.

That is, when weaving the elastic part 20 of the sock 10, the elastic part 20 of the toe sock 10 is formed to have a width larger than the widths of positions in front of or behind the elastic part 20 such that the width of the elastic part 20 becomes the same as the widths of positions in front of or behind the elastic part 20 even though the width is narrowed due to the contraction deformation after the backstitch.

Figure 7:
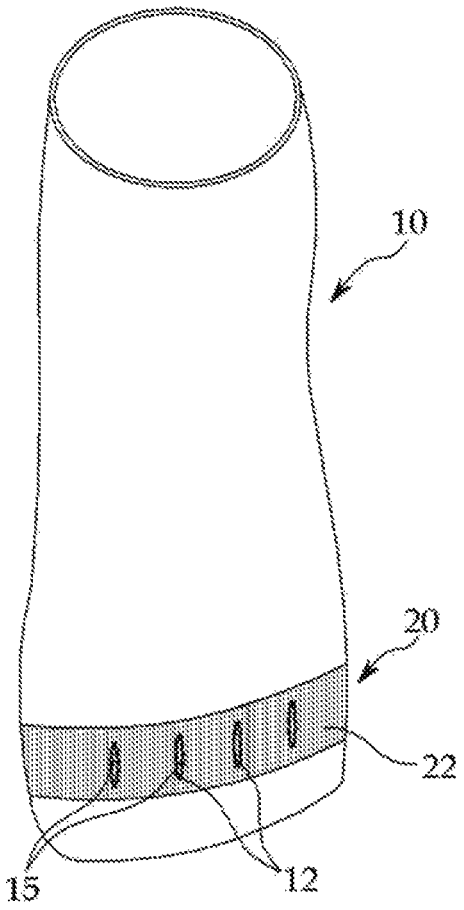
FIG. 7 is a plan view for showing a still further embodiment of the present invention.
Figure 8:
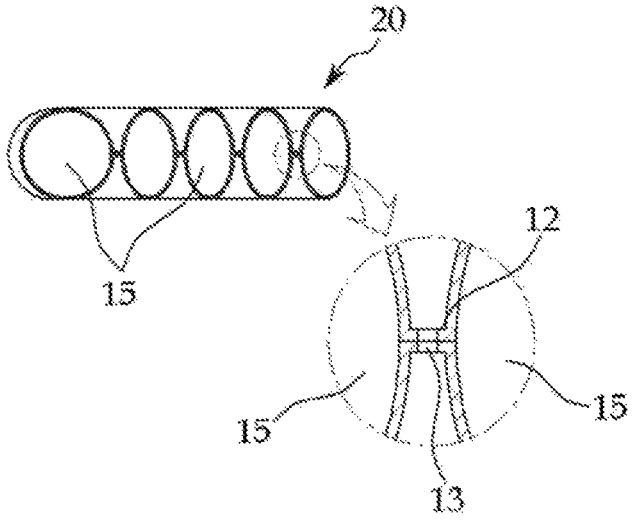
FIG. 8 is a front sectional view for showing an elastic part of FIG. 7.

In addition, a toe sock can be implemented according to another embodiment of the present invention, as shown in FIG. 7 and FIG. 8, in which the sewing lines 12 of the sock are formed in an oval shape and vent holes 13 are formed through the center portions of the sewing lines 12 such that air circulation between toes can be further efficiently provided.

Figure 9:
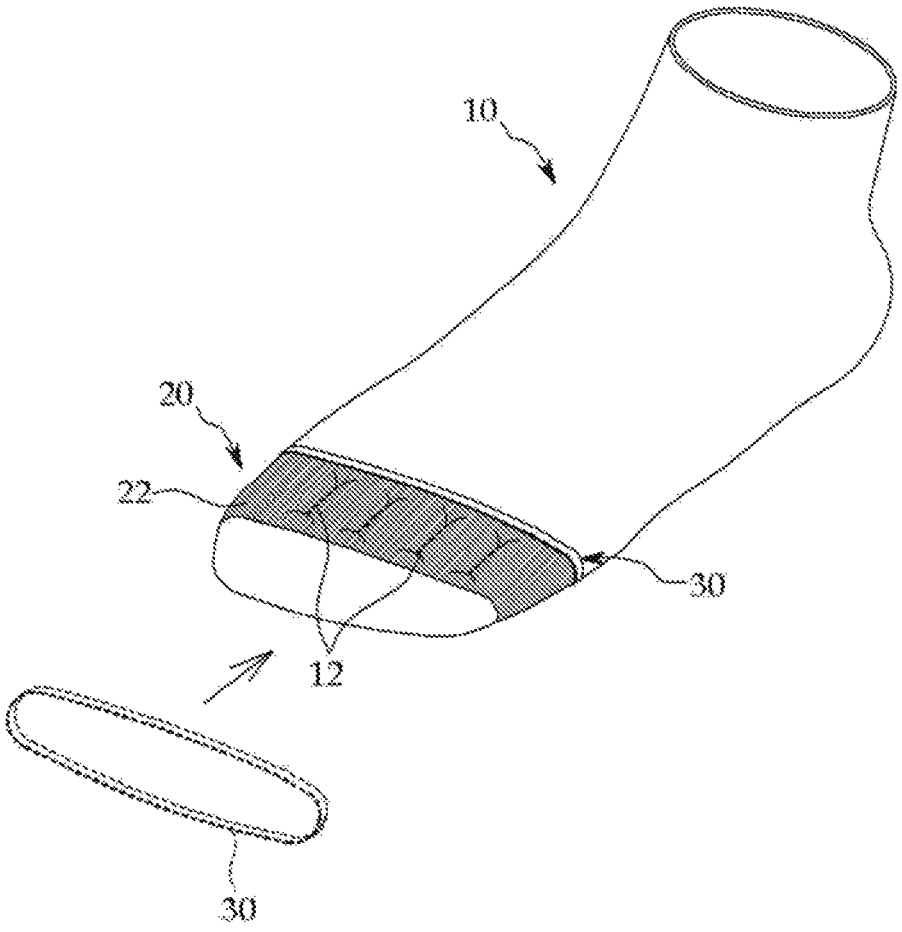
FIG. 9 is a perspective view for showing another embodiment of the present invention, to which a shape maintenance member is applied.

In addition, a toe sock can be implemented according to another embodiment of the present invention, as shown in FIG. 9, in which a shape maintenance member 30 of an oval shape is coupled to the outside of the elastic part 20 of the sock 10, the shape maintenance member 20 being formed of a thin plastic, carbon fiber or the like for supporting the elastic part 20 so as to maintain the open shape of the toe holes 15, thereby providing convenient wearing of the sock.

Now, the wearing and the operational effect of the toe sock according to the present invention configured as above will be described in detail. The toe sock 10 of the present invention is worn by inserting a foot therein such as a general sock.

Herein, the toe holes 15 are divisionally formed in the toe sock 10 by the sewing lines 12 of vertical backstitch between the toe sections if the sock 10 so that respective toes are inserted into the toe holes 15 separately from each other.

Furthermore, as for the portion where the toe holes 15 are formed is formed as the elastic stretch part 20, the elastic part 20 is formed by weaving with the stretch yarn (the rubber thread) and has the stretchable wrinkles 22, which can be stretched in the widthwise direction, such that toes can be conveniently inserted into the toe sock and the toe sock can be easily worn on the toes.

That is, when inserting toes into the toe holes 15, the toe sock is naturally stretched owing to the stretch of the yarn (the rubber thread) as well as the stretch of the wrinkles 22 in the widthwise direction such that the toe sock can be easily worn without stiffness.

Besides, the toe sock has less contraction deformation compared with the conventional to socks thereby exhibiting excellent appearance quality.

Moreover, the elastic part 20 of the sock 10 has the big toe insertion part, of which wrinkles 22' are formed to be more compact so as to be more stretchable than the wrinkles 22 of any other toe insertion parts, thereby providing more effective insertion and wearing of the big toe.

In addition, the shape maintenance member 30 of an oval shape for supporting the open shape of the toe holes 15 is coupled to the outside of the elastic part 20 of the sock 10 so that when the sock is worn, the shape maintenance member 30 spreads the toes insertion part outwards and keeps the open shape of the toe holes 15, thereby providing more effective wearing of the toe sock on the toes.

In addition, the sewing lines 12 of the sock 10 are formed into an oval shape and the vent holes 13 are formed through the center of the sewing lines 12 in the vertical direction, such that the ventilation is smoothly performed between the toes, thereby more effectively preventing athlete's foot.

In addition, in the process of weaving the elastic part 20 of the sock 10, the elastic part 20 of the toe sock 10 is formed to have a width larger than the widths of the positions in front of or behind the elastic part 20 such that the width of the elastic part 20 can maintain the same as the widths of the positions in front of or behind the elastic part 20 even though the width is narrowed due to the sewing lines 12 of the backstitch between the toe sections, thereby providing more effective insertion of the toes into the toe insertion holes 15.

Meanwhile, according to a toe sock manufacturing method according to the present invention, the toe sock configured as above is manufactured by weaving a sock with at least one or more kinds of yarn by a loom according to a program, and then forming the toe holes by vertical backstitch between the toe sections of the sock such that toes are separately inserted thereinto.

Figure 10:
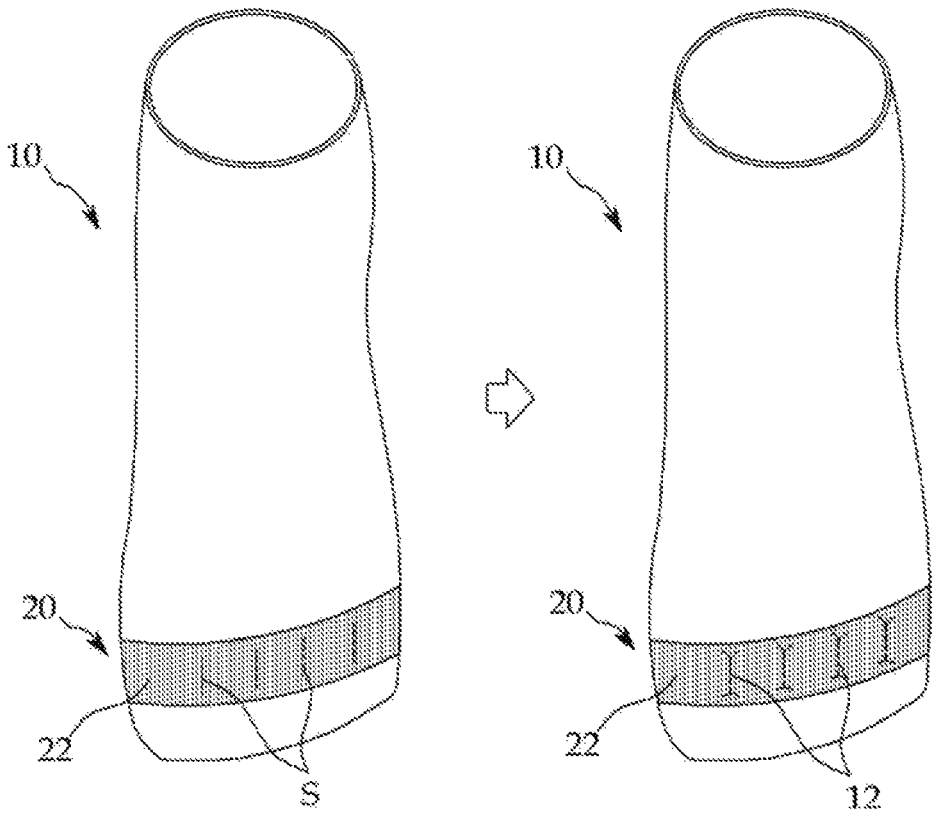
FIG. 10 is a diagram illustrating socks having an elastic part and wrinkles in accordance with embodiments of the present disclosure.

Particularly, as shown in FIG. 10, the sock 10 is woven such that the portion (the elastic part 20) where the toe holes are formed by backstitch in the weaving process of the sock is formed by weaving with stretch yarn in such a manner that backstitch positions are woven with yarn in different color so as to form backstitch indication lines S and then the toe holes, into which toes are separately inserted, are formed by vertical backstitch (the sewing lines 12) along the backstitch indication lines S of the sock.

According to the toe sock manufacturing method according to the present invention, since the portion (the elastic part 20) for forming the toe holes by the backstitch is woven with the stretch yarn (the rubber thread) or woven to have the wrinkles 22 with the stretch yarn (the rubber thread), the toe sock can be easily worn on toes by inserting the toes therein and has less contraction deformation. Therefore, it is possible to manufacture toe socks having excellent appearance quality.

Most of ail, since the backstitch positions are woven with yarn in different color so as to form the backstitch indication lines S, the backstitch of the sewing lines 12 is carried out simply along the backstitch indication lines without using any additional jig after the weaving of the sock, thereby realizing uniform backstitch and providing more excellent marketability.

The invention claimed is:

1. A toe sock having toe holes (15), which are formed by sewing lines (12) of vertical backstitch between the toe sections of a sock (10) and into which toes are separately inserted, characterized in that a portion for forming the toe holes (15) formed by the sewing lines (12) is formed as an elastic stretch part (20), wherein the elastic stretch part (20) is formed by waving with stretch yarn and has wrinkles (22), which are stretchable in the widthwise direction, wherein the sewing line (12) of the sock is formed in an oval shape and a vent hole (13) is formed through the center of the sewing line (12).

2. The toe sock according to claim 1, wherein the elastic part (2) of the sock (10) has a big toe insertion part, of which wrinkles (22') are formed to be fine so as to be more stretchable than the wrinkles (22) of any other toe insertion parts.

3. The toe sock according to claim 1, wherein the elastic part (2) of the sock (10) is formed to have a width larger than at least the widths of positions in front of or being the elastic part (2) and then back-stitched, in consideration of the decrease of the width, caused by the sewing line (12) of the vertical backstitch.

4. The toe sock according to claim 1, wherein the stretch yarn is rubber thread.

5. A method for manufacturing a toe sock, in which, after weaving a sock with at least one or more kinds of yarn by a loom according to a weaving program, toe holes are formed by vertical backstitch between the toe sections of the sock such that toes are separately inserted there into, characterized in that the portion for forming the toe holes by backstitch in the weaving process of the sock is formed by weaving with stretch yarn in such a manner that backstitch positions are woven with yarn in different color so as to form backstitch indication lines and then the toe holes, into which toes are separately inserted, are formed by vertical backstitch along the backstitch indication lines of the sock, wherein the sewing line (12) of the sock is formed in an oval shape and a vent hole (13) is formed through the center of the sewing line (12).

6. A toe sock having toe holes (15), which are formed by sewing lines (12) of vertical backstitch between the toe sections of a sock (10) and into which toes are separately inserted, characterized in that a portion for forming the toe holes (15) formed by the sewing lines (12) is formed as an elastic stretch part (20), wherein the elastic stretch part (20) is formed by waving with stretch yarn and has wrinkles (22), which are stretchable in the widthwise direction, wherein a shape maintenance member (30) is formed in an oval shape and coupled to the outside of the elastic part (2) of the sock (10) so as to support the toe holes (15) such that the toe holes (15) can be maintained in an open shape.

* * * * *